US005255920A

United States Patent [19]

Mangeri

[11] Patent Number: 5,255,920

[45] Date of Patent: Oct. 26, 1993

[54] TRAINING DEVICE FOR GOLFERS

[76] Inventor: John J. Mangeri, 41 Yale Dr., Enfield, Conn. 06082

[21] Appl. No.: 920,091

[22] Filed: Jul. 24, 1992

[51] Int. Cl.[5] ..... A63B 69/36

[52] U.S. Cl. ..... 273/185 C; 273/185 D

[58] Field of Search ..... 273/185 D, 185 C, 184 B

[56] References Cited

U.S. PATENT DOCUMENTS

| | | | |
|---|---|---|---|
| 3,406,571 | 10/1968 | Hackey | 273/185 D |
| 3,738,660 | 6/1973 | Branz et al. | 273/185 D |
| 4,014,522 | 3/1977 | Watson | 273/185 C |
| 4,630,829 | 12/1986 | White | 273/186 A |
| 4,844,469 | 7/1989 | Yasuda et al. | 273/186 R |

*Primary Examiner*—George J. Marlo

[57] ABSTRACT

A relatively inexpensive compact golf training system with digital readouts of the theoretical carry and the distance to the right or left, from a straight drive, caused by either a slice or hook. The system is battery powered, portable and can be used in or out-of-doors by either a right or left handed golfer. There is no restriction on the type of club that can be used. A photodetector is used to reliably sense the movement of a slotted disk on the rotating shaft. The deflection of a stationary flexible disk measures the angle the plane of the rotating ball and tether make, if different from the plane of a straight drive. The system is microprocessor controlled for calculating the carry and distance to the right or left caused by a slice or hook.

3 Claims, 5 Drawing Sheets

TRAINING DEVICE FOR GOLFERS

BACKGROUND

1. Field of Invention

This invention relates to a portable battery powered microprocessor controlled golf training and practice system with digital readouts for ball carry and also the distance, to the right or left of a straight drive, hereby defined as deviation.

2. Description of Prior Art

Many systems available to the golfer help develop his posture, swing and other requisites of a good golf game. Some of these systems require that the golfer wear some physical restraining devices to help in developing a proper swing. Other systems give a digital readout of the ball carry only.

U.S. Pat. No. 4,844,469 has a central processing unit for calculating the statistical carry based on the speed of the golf club. The golf club does not actually strike a golf ball and therefore the golfer does not experience the feel of the club reaction to a struck ball. This system is not applicable when using a putter. In addition there is no numerical indication of the deviation that results from a slice or hook.

U.S. Pat. No. 4,630,829 has a rather expensive portable unit that displays either on a printer or digital readout the club head speed and the elapsed swing time. This patent has limitations similar to the above patent. That is, no ball is actually struck. The statistical distance can be either printed or indicated on a digital readout. In this patent there is no indication of the ball deviation.

U.S. Pat. No. 4,014,552 uses a tethered ball attached to a mechanical meter that indicates approximately the ball travel and expected angle of travel. The distance is a function of the pull on an elastic by the struck golf ball. The angle of direction of travel is registered by a horizontal arm about a vertical axis. Rubber bands exert the restraining forces, for both the ball travel indicator and angle measurement. This raises the question as to the reliability of readings after repeated usage. This device only indicates an approximate angle of travel but does not show the numerical distance to the right or left of a straight drive. To help a golfer with his training, the amount of deviation is vital.

A product sold under the U.S. trademark of "The Swing Groover" is another portable system available to improve a golfer's game. The purchased unit has no patent application number but the statement "U.S. and Foreign Patents Pending" appears on the package. This system has a golf ball tethered to an upright arm and the ball, when struck, is free to rotate about a fixed shaft. The system is to be used outdoors and the base is staked to the ground by 10" plastic stakes. Use of this system has shown that the stakes cannot maintain a firm hold on a grassy surface. After several swings the system must be reset since the centrifugal force is too great for the stakes. Another disadvantage is that a grassy surface must be available and this can cause a city resident some inconvenience. This system has no numerical readouts and the golfer has only an approximate feel for the quality of his hook or slice.

OBJECTS AND ADVANTAGES

The objects and advantages of my above patent are:

a) The golfer actually strikes a golf ball that result in a realistic golf club feel.

b) The system is portable and inexpensive.

c) The golfer's practice sessions can be conducted either indoors or out.

d) The golfer need not wear any restraining equipment, and only his favorite club is required.

e) The golfer develops the proper technique of keeping his eye on the ball since there is no reason to look after it.

f) Proper eye and body coordination is developed because of the ease of repeated tries.

g) The theoretical distance of ball carry and deviation readings are readily available after. This immediately tells the golfer the quality of each stroke.

h) Little time is wasted between strokes since the last readings are easily erased.

BRIEF DESCRIPTION OF THE DRAWINGS

In the drawings each figure presents a view and is further clarified with additional figures when required.

DESCRIPTION—FIG. 1 TO 5

Figure 1:
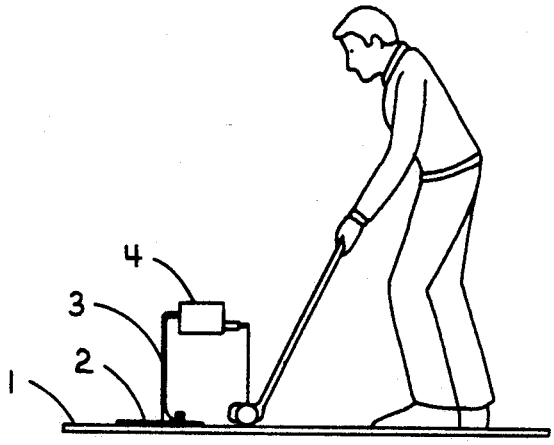
FIG. 1 shows a general view of the system in relation to a golfer.

FIG. 1 shows my handicap eliminator in use by a golfer. The golfers's platform 1 is sufficiently large to accommodate most golfers. Dimensions of approximately 32 inches wide by 57 inches long should suffice. The base plate 2 is firmly attached to the upright arm 3 and platform 1. The housing 4 contains the microprocessor and associated electronic circuits.

Figure 2:
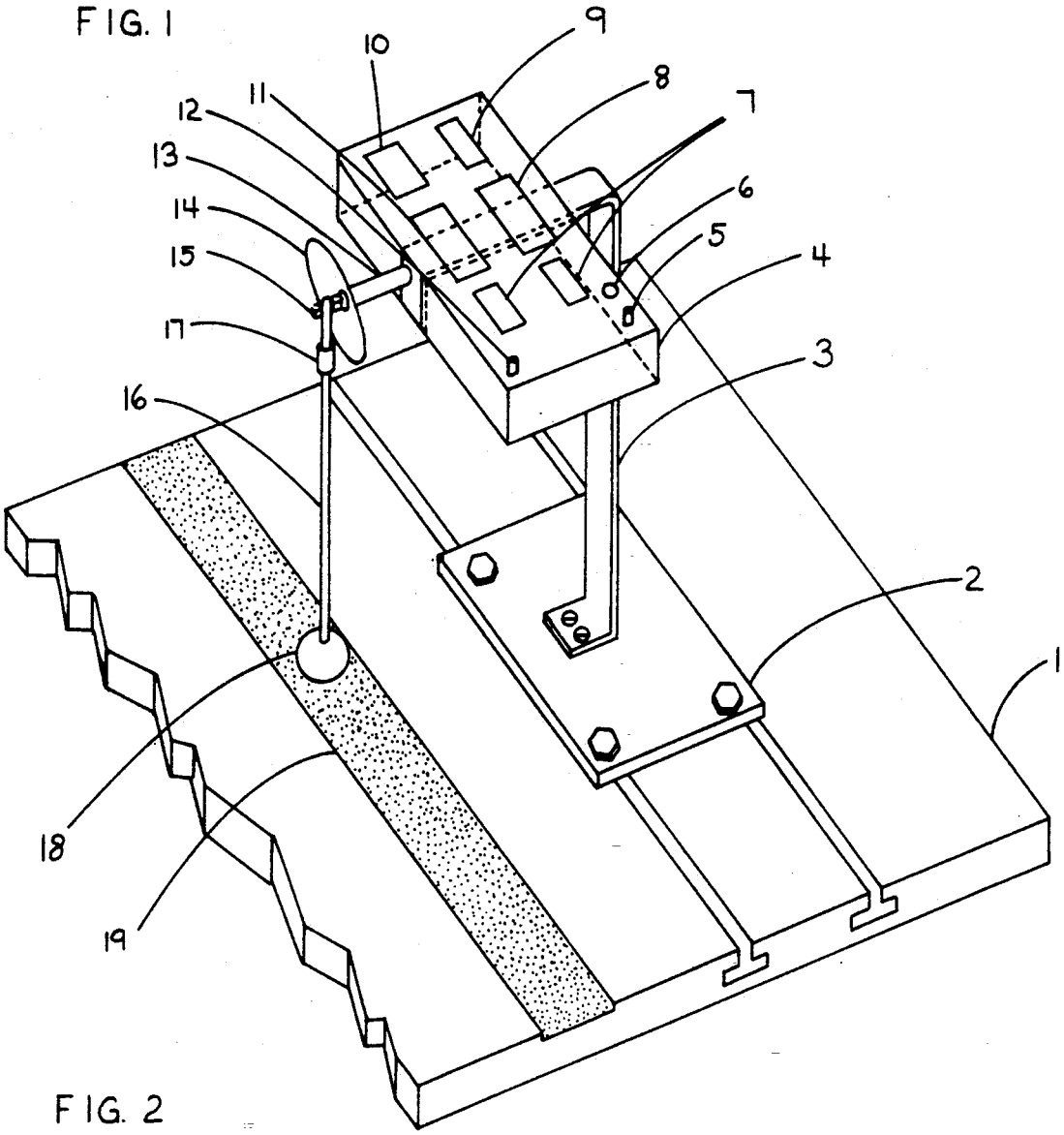
FIG. 2 shows the system with additional details.

FIG. 2 shows the base plate 1 with grooves to allow placing the base plate 2 in any desired location. Also shown is a strip of soft material 19 to prevent golf club damage. An on-off switch 5 is used to initiate operation with light 6 indicating power on or off condition. Printed on the housing is 7 the units of carry or deviation and generally denoted as "Yards". A digital readout 8 indicates the theoretical distance the ball would travel if free to do so. Also printed on the housing is 9 the word "Carry". A readout 10 indicates the offset from a straight drive. The word "Right" for a right handed golfer's slice or a left hander's hook. The word "Left" for a right hander's hook or a left hander's slice. A digital readout 11 indicates the theoretical deviation the ball would travel. A reset switch 12 clears all readings prior to the next swing. A shaft housing 13 is firmly attached to the upright arm 3 by welding or any other positive means. A flexible disk 14 is used to measure the angle, the rotation plane a slice or hook makes, with relation to a straight drive. This disk must be firmly attached to the shaft housing either by rivets or any other positive means. A shaft 15, that rotates freely in the housing 13, has firmly clamped to it the tether cord 16. This cord must be strong enough to resist the tension exerted by the rotating ball. A commercially available heavy duty nylon rope with a minimum diameter of 3/16 of an inch is a good choice. A disk deflector 17 is a non abrasive material clamped to the tether cord and a golf ball 18 is attached to the tether cord.

Figure 3:
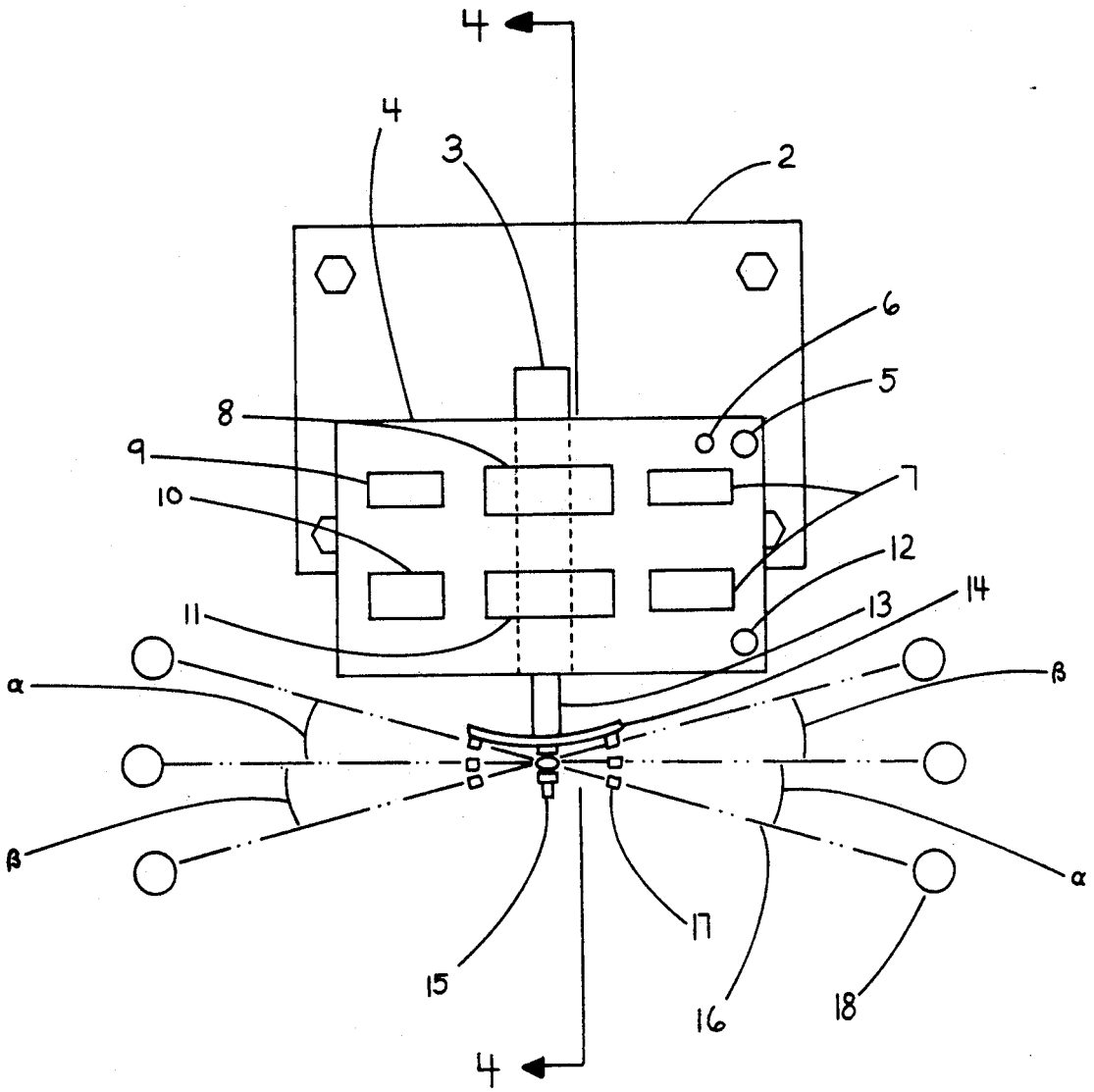
FIG. 3 shows a top view with the swinging ball and tether in various rotating positions.

FIG. 3 is a top view of the Golfer's Handicap Eliminator showing the possible ball and tether motions. Angle $\alpha$ and angle $\beta$ are the angles the planes of rotation make with the plane of a straight drive. Angle $\alpha$ corresponds to a slice for a right handed golfer and a hook for a left handed golfer. Conversely angle $\beta$ is a hook for a right handed golfer and a slice for a left handed golfer. This view also shows the flexible disk 14 deflected by the motion of the disk deflector 17. For the sake of clarity platform 1 is not shown.

Figure 4:
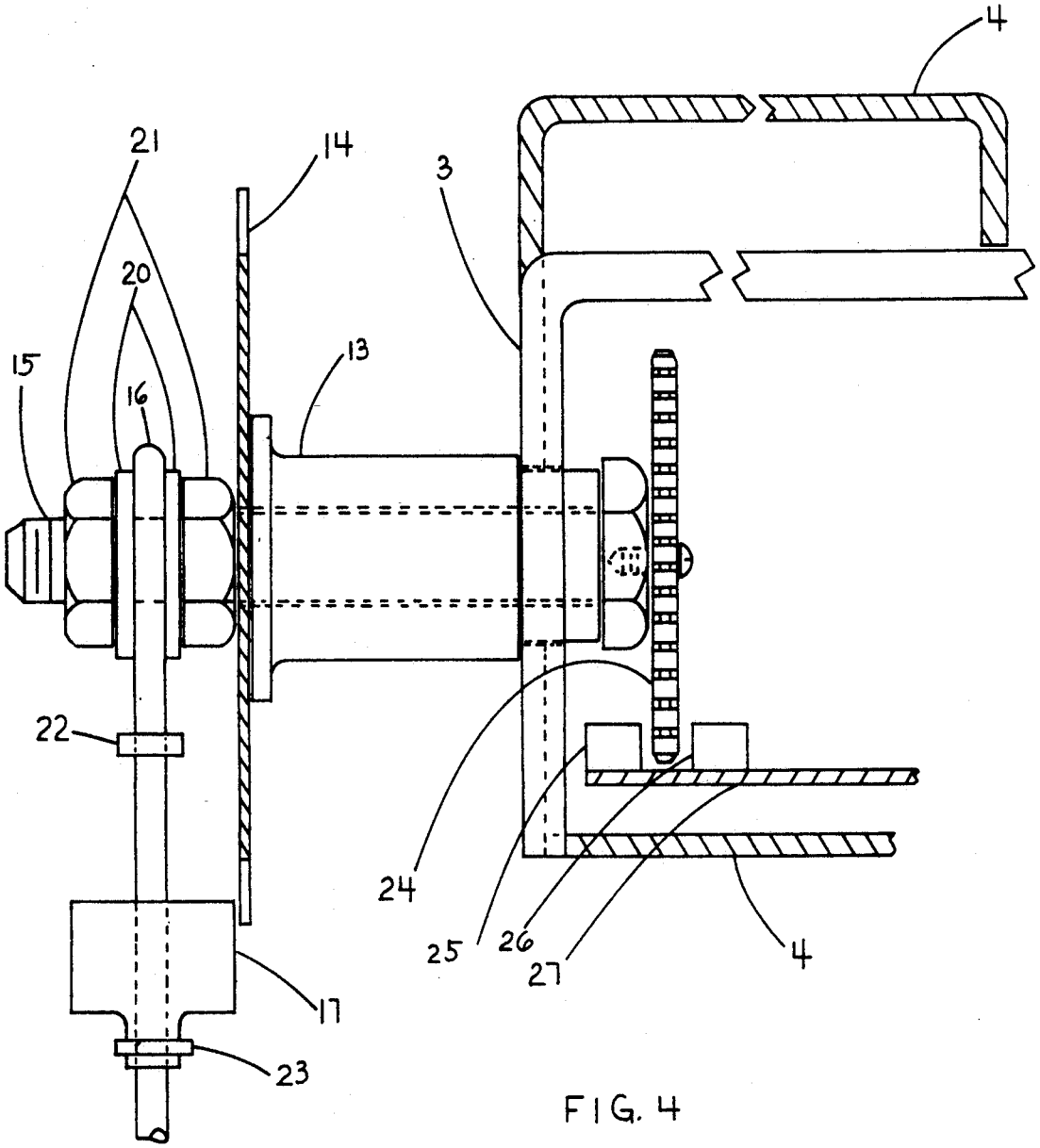
FIG. 4 shows details of the working parts of the system.

FIG. 4 shows details of the shaft made from a standard ¼ by 20 bolt. Other details of those parts necessary for the proper operation are shown. The washers 20 protect the soft material of the tether cord. The nuts 21 are tightened against each other to firmly clamp the tether cord to the shaft. A metal squeeze clamp 22 ties the two ends of the tether cord. A metal squeeze clamp 23 firmly holds the disk deflector to the tether cord. A disk 24 with perforations, such as a standard commercially available gear, is attached to the rotating shaft. The gear teeth interrupt the light beam from an LED 25 to a phototransistor 26. The circuit board 27 contains the power supply, microprocessor and associated electronic circuits.

Figure 5:
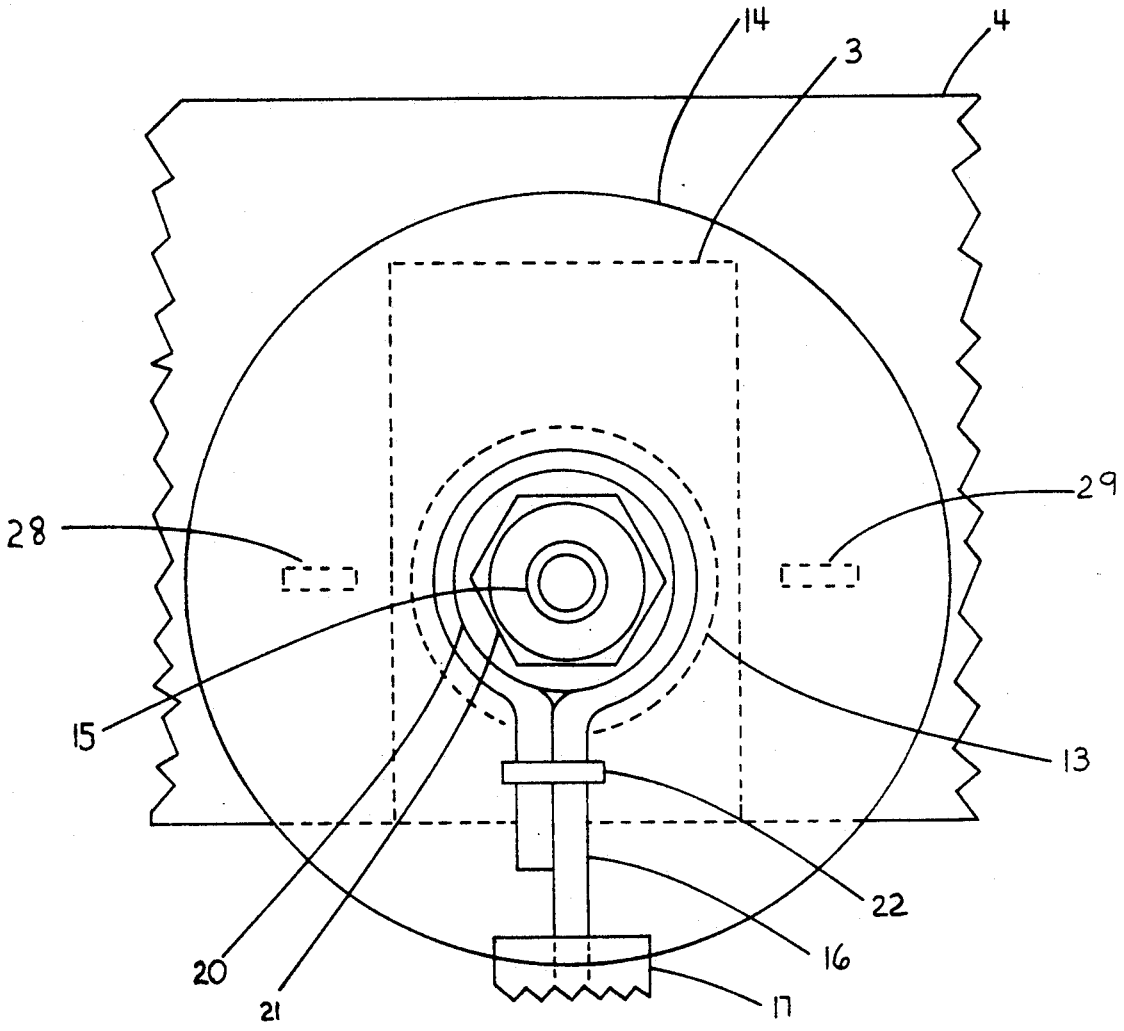
FIG. 5 shows the front view of FIG. 4 with two additional parts, the strain gages.
Figure 6:
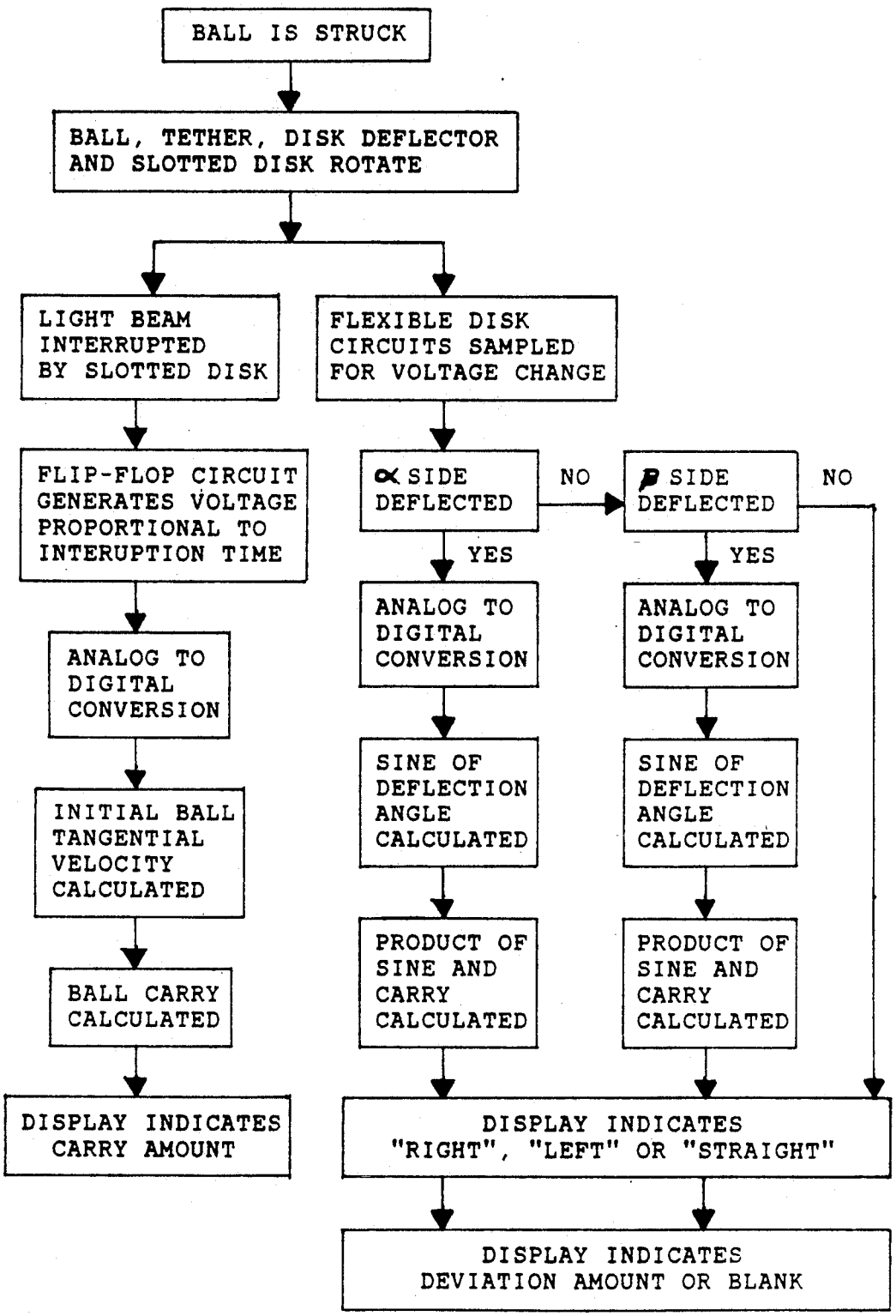
FIG. 6 shows the block diagram of the system in operation.

FIG. 5 is a frontal view of FIG. 4. The only additional parts are the strain gages 28 and 29 located on the back surface of the flexible disk 14. Gage 28 detects the disk deflection if the deviation is to the right. Gage 29 if the deflection is to the left. This deflection is a measure of the angle, the plane of the swinging ball and tether make, with the plane of a straight drive. FIG. 6 is a block diagram showing the series of events after the ball is struck. The initial ball velocity is calculated by measuring the time the ball rotates through a fixed angle. This velocity is then used to calculate the ball carry and is indicated on the digital readout 8 of FIG. 2. Rotating ball and tether cause the disk deflector 17 to bend the flexible disk 14 which in turn determines the maximum strain gage instantaneous deflection to determine the right or left deviation angle. If this angle is $\alpha$ readout 10 indicates right and indicates left if the angle is $\beta$. The sine of the angle is used to give a deviation digital readout in 11.

SUMMARY, RAMIFICATIONS, AND SCOPE

Accordingly, the reader will see that the golf practice and training system of this invention is convenient and portable and can be used in and out-of-doors. Because the quality of each stroke is visibly indicated the golfer can continue practicing by improving his stroke in the next try. Since the system is battery powered and portable there is no restriction as to the location it can be used. This is a definite advantage to the city dweller who does not have easy access to a practice area.

Although the description above contains many specifications, these should not be construed as limiting the scope of the invention but as merely providing illustrations of some of the preferred embodiments of this invention. For example, the interruption of the light source by the disk on the shaft can be replaced by any other system, such as a magnetic pickup, to mention one of several available. Measuring the angle due to a hook or slice, by the bending of the flexible disk, is only one of many possible methods to determine the angle the plane, of the rotating ball and tether, makes with the plane of a straight drive.

Thus the scope of the invention should be determined by the appended claims and their legal equivalents, rather than by the examples given.

I claim:

1. A golf practice and training system comprising: a platform, a base plate; means for firmly attaching said base plate to said platform; an upright arm; means for attaching said upright arm to said base plate; a housing; means for attaching said housing to said upright arm; a shaft; means for attaching said shift to said housing for unrestricted rotation of said shaft about a horizontal axis; an LED light source; a detector; means for attaching the LED light source and detector inside the housing; a slotted disk; means for attaching the slotted disk to the shaft and located between the LED and detector; a strain gaged flexible disk; means for attaching the strain gaged flexible disk to the housing; a golf ball; a disk deflector; a tether cord; means for attaching the golf ball and disk deflector to the tether cord; means for attaching the tether cord to said shaft; means for providing a digital readout of the theoretical ball carry; and means for providing a digital readout of the amount of theoretical deviation either right or left of a straight drive of said ball.

2. The system of claim 1 including means of calculating the ball carry from the time interval the solid portion of said; radial disk intersects said light source.

3. The system of claim 1 including means for calculating the distance the ball travels to right or left, of a straight drive, by the amount of deflection of said flexible disk.

* * * * *